United States Patent [19]

DeNise

[11] Patent Number: 4,557,336

[45] Date of Patent: Dec. 10, 1985

[54] ALIGNMENT MECHANISM FOR RAM TYPE COMPACTORS

[75] Inventor: Richard A. DeNise, Hemlock, N.Y.

[73] Assignee: Stone Construction Equipment, Inc., Honeoye, N.Y.

[21] Appl. No.: 425,044

[22] Filed: Sep. 23, 1982

[51] Int. Cl.[4] ..... E01C 19/30

[52] U.S. Cl. ..... 173/90; 173/118; 173/123; 404/133

[58] Field of Search ..... 173/90, 122, 123, 117, 173/118; 404/133; 308/3 R

[56] References Cited

U.S. PATENT DOCUMENTS

| | | | |
|---|---|---|---|
| 1,981,992 | 11/1934 | Curtis | 308/3 R |
| 3,277,801 | 10/1966 | Horvath et al. | 404/133 |
| 3,308,728 | 3/1967 | Brown | 404/133 |
| 3,635,133 | 1/1972 | Stougaard | 404/133 |

*Primary Examiner*—James Wolfe

*Attorney, Agent, or Firm*—Harvey B. Jacobson

[57] ABSTRACT

A mechanism for maintaining alignment between the gear case or upper portion of a ram type compactor and the spring housing and shoe or lower portion of the compactor which includes a square guide tube and a square hole at the top of the spring housing which reciprocally accepts the guide tube and a segmental wear resistant bearing or bushing forming a lining for the square hole with the bearing being retained in position by the guide tube which extends therethrough and held stationary by the springs in the spring housing. This mechanism enables a person operating a ram type compactor to more effectively handle and maintain proper directional control of the machine.

2 Claims, 4 Drawing Figures

ALIGNMENT MECHANISM FOR RAM TYPE COMPACTORS

BACKGROUND OF THE INVENTION

1. Field of the Invention

The present invention generally relates to ram type compactors for use in compacting soils and more particularly to a novel and unique alignment mechanism between the upper portion of the machine and the lower portion of the machine in which the upper portion of the machine has a square guide tube forming a portion thereof and the lower portion of the machine has a spring housing provided with a square hole in the upper end in which the hole is lined with a segmental bearing in engagement with the square guide tube.

2. Description of the Prior Art

In the present construction of ram type compactors, it is desirable to maintain alignment between the gear case or upper portion of the compactor and the spring housing or lower portion of the compactor in order for the operator to more effectively operate and control the compactor. Present methods for accomplishing this include the use of a bellows type boot interconnecting the guide tube forming a portion of the gear case and the spring housing with the boot maintaining alignment to the extent that the boot has torsional resistance. As the boot is used, it becomes more flexible and weakens thereby reducing its torsional resistance. This decrease in torsional resistance permits misalignment between the gear case or upper portion of the machine and the spring housing with the tamping shoe thereon or the lower portion of the machine thereby creating handling and maneuverability problems. Another method which has been used to maintain alignment of the upper and lower portions of the compactor is the use of guide pins on one portion of the machine received in holes, slots or grooves in the other portion of the machine. The use of guide pins requires that the guide tube forming a portion of the gear case or upper portion of the machine and the spring housing maintain substantially constant orientation throughout the entire length of the stroke.

The following U.S. patents disclose various structures in ram type compactors, tamping devices and the like in which, in some instances, structures are provided to maintain alignment of the upper portion of the compactor and the lower portion thereof.

U.S. Pat. No. 3,017,810, 01/23/62
U.S. Pat. No. 3,073,219, 01/15/63
U.S. Pat. No. 3,236,164, 02/22/66
U.S. Pat. No. 3,286,790, 11/22/66
U.S. Pat. No. 4,104,001, 08/01/78

SUMMARY OF THE INVENTION

An object of the present invention is to provide an alignment mechanism between the upper and lower portions of a ram type compactor in the form of a square guide tube connected with the gear case or upper portion of the machine and a square hole in the upper end of the spring housing receiving the guide tube with bearing segments forming a lining for the hole in the upper end of the spring housing and in bearing engagement with the periphery of the square guide tube thus maintaining the gear case and tamping shoe in alignment during operation of the compactor.

Another object of the invention is to provide an alignment mechanism in accordance with the preceding object in which the hole in the upper end of the spring housing is machined to form an inwardly projecting rib around the inner periphery thereof receiving the bearing segments which have a corresponding groove in the external surface thereof thereby locking the bearing segments to the spring housing with the end edges of the bearing segments overlapping in a manner that enables installation in the square hole and retention of the bearing segments therein by the square guide tube engaged by the inner surfaces of the bearing segment.

A further object of the invention is to provide an alignment mechanism in accordance with the preceding objects in which the spring housing and gear case are connected by a bellows boot which prevents entry of foreign material into the engaging surface areas of the square guide tube and bearing segments.

Still another object of the present invention is to provide an alignment mechanism for ram type compactors which is simple in construction, long lasting and durable and effective for maintaining alignment of the upper and lower portions of a ram type compactor to enable an operator of the compactor to handle and maneuver the compactor in a more efficient manner.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
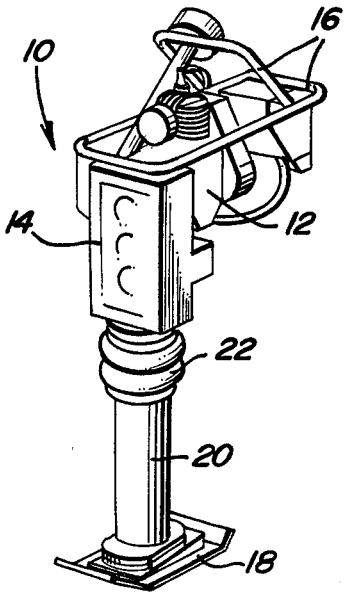
FIG. 1 is a perspective view of a ram type compactor with the alignment mechanism of the present invention incorporated therein.
Figure 2:
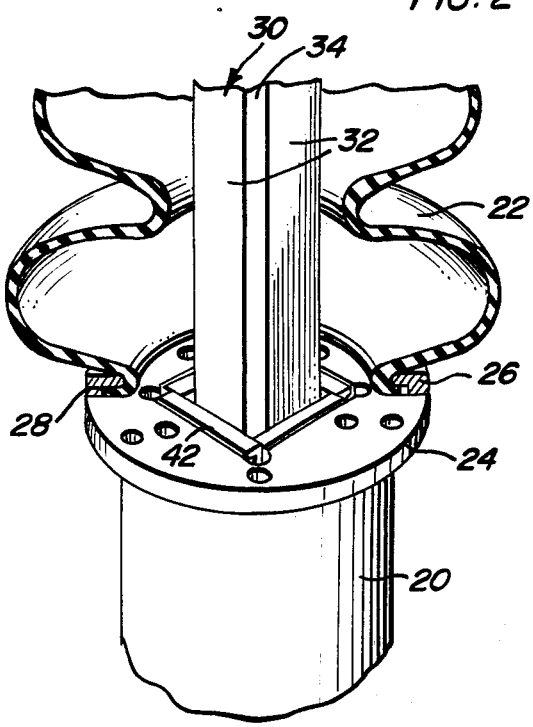
FIG. 2 is an enlarged perspective view of the upper end of the spring housing and the lower end of the square guide tube with the lower portion of the boot being broken away to illustrate the relationship of the components of the invention.

Referring now specifically to the drawings a ram type compactor is generally designated by numeral 10 and which may include the usually provided internal combustion engine 12 connected with and supported by a gear case 14 or upper portion of the machine with a handle assembly 16 being connected to the gear case and engine to provide an arrangement by which the compactor 10 may be controlled by an operator. Also, the lower end portion of the compactor 10 includes a tamping shoe 18 and an upwardly extending substantially cylindrical spring housing 20 which forms the lower portion of the machine. The aforementioned structure of the compactor is conventional and during operation of the compactor, it is desirable to maintain the tamping shoe 18 in alignment with the gear case 14 so that an operator using the compactor 10 may more easily control and maneuver the compactor 10 when using the handle assembly 16. Also, a flexible, bellows-type boot 22 interconnects a flange 24 at the upper end of the spring housing 20 and the lower end of the gear case 14 with a retaining flange 26 securing a bead 28 on the end of the boot 22 to the flange 24 and also being connected to the gear case in a similar manner with this structure also being of conventional construction with the boot 22 being constructed of resiliant material such as rubber or the like.

The present invention resides specifically in a construction of a guide tube 30 which is of square construction and provided with four flat surfaces 32 arranged in perpendicular relationship with the surfaces being of equal dimension and the corners of the guide tube 30 being chamfered or rouded as at 34. Conventionally, the guide tube that is connected to the lower end of the gear casing is provided with a cylindrical exterior configuration but in the present invention, this guide tube is squared by providing four flat surfaces 32 with the flat surfaces 32 being formed by machining the exterior surfaces of the tube into a square configuration with the interior of the guide tube 30 being adequate in size to receive the piston driven by a crank shaft, crank and connecting rod all oriented in the gear case 14 in a conventional manner.

Figure 3:
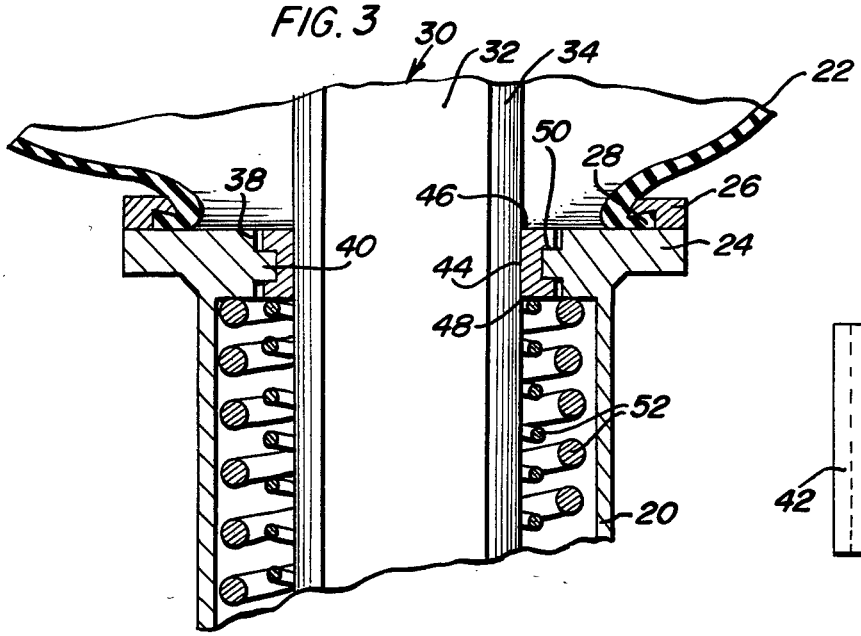
FIG. 3 is a vertical sectional view of the structure of FIG. 2 illustrating further structural relationships of the components of the present invention.
Figure 4:
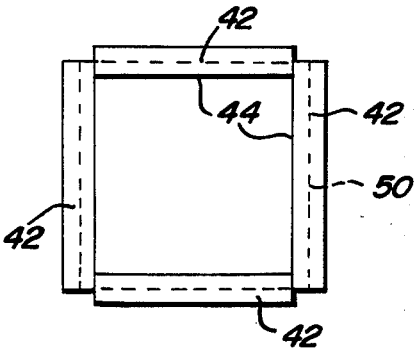
FIG. 4 is a plan view of the bearing segments.

The flange 24 at the upper end of the spring housing 20 is provided with a square hole 38 receiving the square guide tube 30 with the inner periphery of the hole 38 including a projecting rib or flange 40 which is located centrally of the vertical height of the periphery of the square hole 38 and has parallel top and bottom surfaces that are perpendicular to the inner surface of the periphery of the hole 38 and an inner surface that is parallel to the inner periphery of the hole 38 and perpendicular to the top and bottom surfaces of the rib thus, in effect, forming a substantially square rib that is oriented centrally between the top and bottom edges of the flange 24 as illustrated in FIG. 3. Positioned in the square hole 38 and engaging the external peripheral surface of the square guide tube 30 is a plurality of bearing segments 42 of wear-resistant material such as high density bronze or hardened steel or the like. Each bearing segment 42 is of generally channel shaped configuration and provided with an inner surface 44 in bearing engagement against the corresponding flat surface 32 of the guide tube 30. Also, each bearing segment includes top and bottom surfaces 46 and 48 which are perpendicular to the surface 44 and in alignment with the top and bottom surfaces of the flange 24 which forms the top of the spring housing 20 as illustrated in FIG. 3. The outer surface of each bearing segment is provided with a groove 50 corresponding to the shape, size and configuration of the rib 40 for telescopically receiving the rib 40 as illustrated in FIG. 3 with there being very minimal clearance between the inner surface of the hole 38 and the outer surface of the bearing segments 42 with it being preferable that the inner surfaces of the hole 38 and rib 40 being engaged with the corresponding outer surfaces of the bearing segments 42 for proper support of the bearing segments 42. As illustrated, the springs 52 in the spring housing 20 have their upper ends engaged with the flange 24 and the bearing segments 42 to stabilize the bearing segments and to prevent any looseness of the bearing segments resulting in chattering or the like during reciprocation of the spring housing and square guide tube in relation to each other. Also, as illustrated, the opposed bearing segments are of different lengths, that is, one pair of the bearing segments are longer than the other pair as illustrated in FIG. 4 so that the two shorter bearing segments will telescope internally of the end portions of the two longer bearing segments 42 thus further serving to retain the bearing segments in proper orientation with the chamfered corners 34 of the guide tube 30 being aligned with the internal corners defined by the perpendicularly arranged bearing segments 42.

The structure of the square guide tube assembly and the square hole 38 combined with the bearing segments provides a larger bearing surface for longer wear life of the frictionally engaged components. This structure also eliminates the necessity of using guide pins interconnecting the guide tube and gear case and provides for easy servicing of the machine since it is quite simple to remove the guide tube 30 and replace the bearing segments 42. This provides maximum torsional stability and proper alignment without the boot 22 being subjected to torsional forces which tends to further weaken the boot. The boot may be constructed of a fiber reinforced material for extra strength with a high resistance to punctures and abrasions with the elimination of torsional forces being applied thereto prolonging the life expectancy of the boot.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a ram type compactor having an engine, gear case and handle assembly fixedly associated in relation to each other, a spring housing with spring means therein extending downwardly from a point below the gear case and a tamping shoe rigid with the lower end thereof, said spring housing being drivingly connected to the engine through the spring means for reciprocating the spring housing and tamping shoe, a flexible bellows-type boot interconnecting the gear case and the upper end of the spring housing to enable relative movement therebetween and enclose the space therebetween, a guide member connected with the gear case and extending from the gear case through the interior of the boot and downwardly into the spring housing, the upper end of the spring housing including a hole reciprocally receiving and guiding said guide member with the guide member guiding movement of the spring housing during reciprocal movement of the spring housing and tamping shoe, said tamping shoe including a major longitudinal dimension paralleling the major longitudinal dimension of the engine, gear case and handle assembly to enable an operator to directionally control the compactor, that improvement comprising said guide member and said hole being of corresponding polygonal cross-sectional configuration for preventing relative angular displacement of the spring housing about an axis extending longitudinally of the guide member thereby retaining the tamping shoe from angular displacement about the same axis without exerting torsional forces on the flexible boot and bearing means lining the internal surface of the hole and engaging the external surface of the guide member.

2. The combination as defined in claim 1 wherein said hole is square and said guide member is square in cross-sectional configuration, said bearing means including bearing segments mounted on each side of the hole in engagement with the external surfaces of the guide member, each bearing segment being of channel-shaped configuration and having an outwardly facing groove, each side of the opening having an inwardly extending rib received in the groove whereby the guide member retains the bearing segments mounted on the edges of the hole without the use of fasteners.

* * * * *